United States Patent [19]

Faber

[11] Patent Number: 4,662,310

[45] Date of Patent: May 5, 1987

[54] ROBOTIC PAINT MASKING MACHINE

[75] Inventor: Elmer L. Faber, Temperance, Mich.

[73] Assignee: Deco Tools, Inc., Toledo, Ohio

[21] Appl. No.: 883,640

[22] Filed: Jul. 9, 1986

[51] Int. Cl.[4] ..... B05L 13/02

[52] U.S. Cl. ..... 118/503; 118/504

[58] Field of Search ..... 118/301, 504, 720, 721, 118/503

[56] References Cited

U.S. PATENT DOCUMENTS

| | | | |
|---|---|---|---|
| 2,883,960 | 4/1959 | Way et al. | 118/301 |
| 3,128,205 | 4/1964 | Illsley | 118/49 |
| 3,380,434 | 4/1968 | Faber | 118/504 X |
| 3,598,083 | 8/1971 | Dort | 118/53 X |
| 3,643,625 | 2/1972 | Mahl | 118/530 X |
| 3,656,453 | 4/1972 | Tousimis | 118/53 X |
| 3,741,154 | 6/1973 | Szczepanske | 118/504 X |
| 3,749,058 | 7/1973 | Slabaugh | 118/500 |
| 3,783,822 | 1/1974 | Wollam | 118/500 X |
| 3,853,091 | 12/1974 | Christensen et al. | 118/53 X |
| 3,858,547 | 1/1975 | Bergfelt | 118/53 X |
| 3,861,353 | 1/1975 | Erhart et al. | 269/57 X |
| 3,926,421 | 12/1975 | Reiger, Jr. et al. | 269/57 |
| 3,983,838 | 10/1976 | Christensen | 118/53 X |
| 3,986,478 | 10/1976 | Galvin | 118/53 X |
| 4,022,156 | 5/1977 | Esterline | 118/504 |
| 4,034,704 | 7/1977 | Wossner et al. | 118/49 |
| 4,221,286 | 9/1980 | Galer et al. | 198/377 |
| 4,222,345 | 9/1980 | Bergfelt et al. | 118/720 |
| 4,271,209 | 6/1981 | DePalma et al. | 427/58 |

OTHER PUBLICATIONS

Brochure entitled, "NUMATROL II, The All-Air Moving Part Logic Control System, Installation & Maintenance Manual IMM-78", distributed by NUMATICS Incorporated, dated 1978.

Brochure entitled, "ALLENAIR Rotary Index Tables", distributed by Allenair Corp., dated Mar. 18, 1984.

Brochure entitled, "FLOW-TORK Air Rotary Actuators", distributed by Flow-Tork, Inc., not dated.

*Primary Examiner*—John P. McIntosh

*Attorney, Agent, or Firm*—Emch, Schaffer Schaub & Porcello Co.

[57] ABSTRACT

A robotic paint masking machine is disclosed. The machine consists of a rotatable table pivotally mounted on a base. The rotatable table is operatively connected to a rotary actuator. The rotary actuator has the ability to rotate the rotatable table 180 degrees. Two mask holders are positioned on the rotatable table in opposed relationship to one another. Each mask holder includes a vertically movable frame for holding a decorative mask. Two rotary indexing units are mounted between the rotatable table and the mask holders for rotating the mask holders during a painting operation.

9 Claims, 10 Drawing Figures

ROBOTIC PAINT MASKING MACHINE

BACKGROUND OF THE INVENTION

The invention relates generally to an apparatus which positions and masks an article during a coating operation. More specifically, the invention is directed to a machine which rotates an article from a loading/unloading station to a coating station and then returns the article to the loading/unloading station after a coating operation by a painting robot or other means has been completed. The machine also masks and rotates the article while the article is positioned at the coating station during a coating operation.

Machines having capabilities for rotating objects are known in the art. It has been found, however, that such machines are unsatisfactory when it is desired to quickly coat an article with a high degree of accuracy and uniformity. The present apparatus overcomes the prior art disadvantages.

SUMMARY OF THE INVENTION

The present invention is directed to an apparatus for positioning and masking an article during a coating operation by a painting robot or other painting means. The apparatus includes a base, a rotatable table pivotally mounted on the base, a rotary actuator, two mask holders positioned on the rotatable table and two rotary indexing units mounted between the table and the mask holders.

The base includes a plurality of legs, a plurality of support members attached in a perpendicular relationship to the legs, a bearing unit on which the rotatable table rests, and a shot pin assembly which is retracted when the table is being rotated and extended to stabilize the table after the table has been rotated to the work station.

The rotatable table is pivotally mounted on the base by a shaft which is operatively connected to the rotary actuator that is positioned on the support members. The table rests on ball bearing units located on the top of the base. The table rotates 180 degrees on its axis when the shaft is moved by the rotary actuator.

The rotary actuator includes a pneumatically controlled rack and pinion gear assembly. The shaft is attached to the pinion gear by a keyway. When the rotary actuator is activated, a rack and pinion assembly turns the shaft which is connected to the rotatable table. This rotates the table.

Two mask holders are positioned on the rotatable table in opposed relationship to one another. Each mask holder includes a turntable operatively connected to a rotary indexing unit, a platform, a rest pad to support an article to be coated, two rest pad cylinders positioned between the rest pad and the platform to raise and lower the rest pad, a mask holder frame on which a decorative mask is attached in order to mask the article to be coated, and two mask holder frame cylinders to vertically move the frame in relation to the rest pad.

The rotary indexing units positioned between the rotatable table and the mask holders rotate the mask holders 360 degrees when the mask holders are positioned at the coating station during a coating operation. Each rotary indexing unit includes a base plate attached to the rotatable table, a pneumatic drive cylinder, a gear and rack assembly attached to an index plate, two pawl stops to prevent movement of the index plate, and a center stud positioned on the index plate on which the mask holder is mounted.

In operation, an article to be coated is placed on the rest pad of a mask holder. The rest pad cylinders then raise the rest pad. The mask holder frame, which is in a raised vertical position while the article is being placed on the rest pad, is lowered into position over the article. The shot pin is retracted. The rotary actuator then rotates the shaft attached to the rotatable table thereby causing the table to rotate 180 degree. The mask holder which had been at the loading/unloading station is now at the coating station. Likewise, the mask holder which had been at the coating station is now at the loading/unloading station.

The mask holder which had been at the coating station is unloaded by the operator and loaded with another article to be coated. The mask holder which is at the coating station has the capability to be rotated 360 degrees during the coating operation by the rotary index unit to which it is mounted.

After the coating operation is completed the shot pin is retracted. The rotary actuator then rotates the rotatable table 180 degrees so that the mask holder which is at the coating station is returned to the loading/unloading station. The shot pin is extended to hold the rotatable table in place. The finished article is removed from the mask holder. A new article is loaded on the mask holder. The operation of the machine is then repeated.

It is an object of the present invention to provide an apparatus which can support and mask an article during a coating operation by a robot.

It is a further object of the present invention to provide an apparatus which can quickly rotate and position an article during a coating operation by a robot.

Other objects and advantages of the invention will become apparent as the invention is described hereinafter in detail and with references to the accompanying drawings.

DETAILED DESCRIPTION OF THE PREFERRED EMBODIMENT

Figure 1:
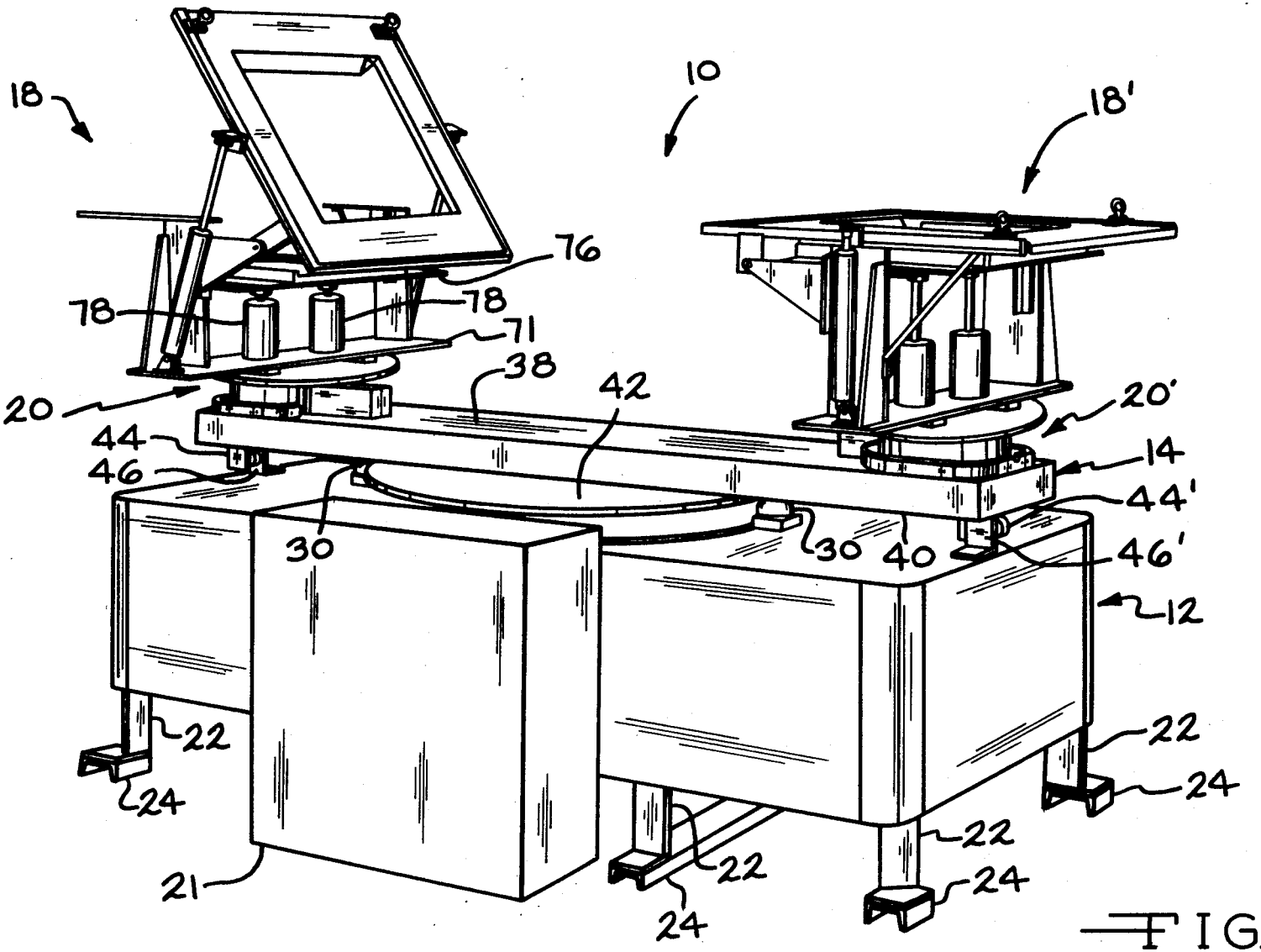
FIG. 1 is a perspective view of a robotic paint masking machine, according to the present invention.
Figure 2:
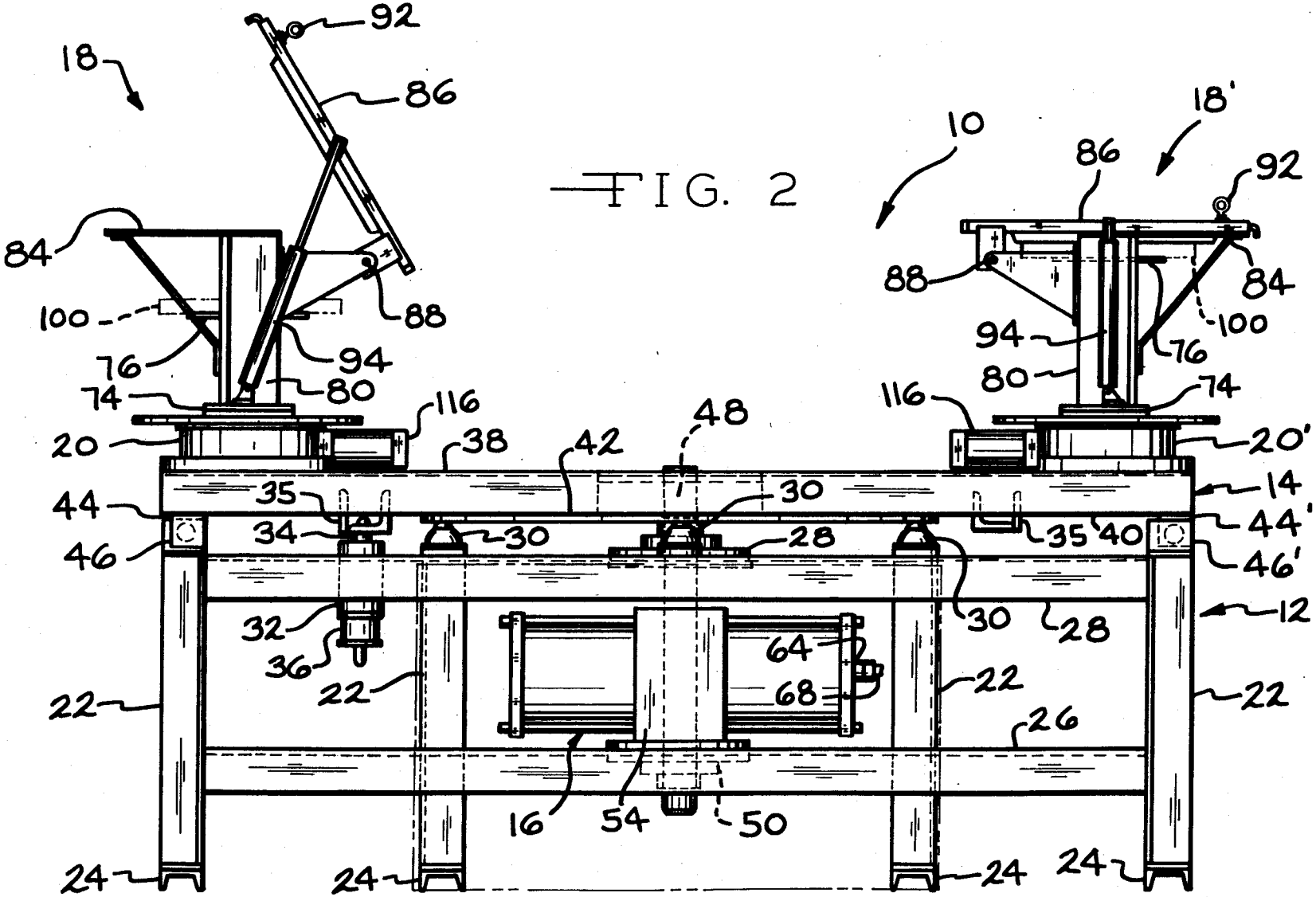
FIG. 2 is a side elevational view of the apparatus shown in FIG. 1.

Referring now to the drawings, and to FIGS. 1 and 2 in particular, a robotic paint masking machine 10 is shown. The machine 10 generally includes a base 12, a rotatable table 14, a rotary actuator 16, two mask holders 18 and 18' and two rotary indexing units 20 and 20'. The machine 10 further includes a pneumatic control system 21 (see FIGS. 1 and 10) which is operatively connected to the rotary actuator 16, the mask holders 18 and 18' and the rotary indexing units 20 and 20'.

The base 12 is best shown in FIG. 2. The base 12 includes a plurality of legs 22 having feet 24. The base 12 further includes a first set of support members 26 and a second set of support members 28. The first set of support members 26 are attached in a perpendicular relationship to the legs 22 along the bottom portion of the base 12. The second set of support members 28 are attached in a perpendicular relationship to the legs 22 along the upper portion of the base 12.

Still referring to FIG. 2, a plurality of ball bearing units 30 are positioned on legs 22. In the present embodiment, four ball bearing units 30 are positioned on four of the legs 22. The ball bearing units 30 are used to facilitate the rotation of the rotatable table 14 when the machine 10 is in operation.

As shown in FIG. 2, the base 12 further includes a pneumatic shot pin assembly 32. The shot pin assembly 32 includes a shot pin 34 and a shot pin cylinder 36 for actuating the shot pin 34. The shot pin assembly 32 is mounted on the second set of support members 28. The shot pin 34 engages a U-shaped retainer 35 which is mounted on the rotatable table 14 in order to hold the table in place. The shot pin assembly 32 is operatively connected to the pneumatic control unit 21.

Figure 3:
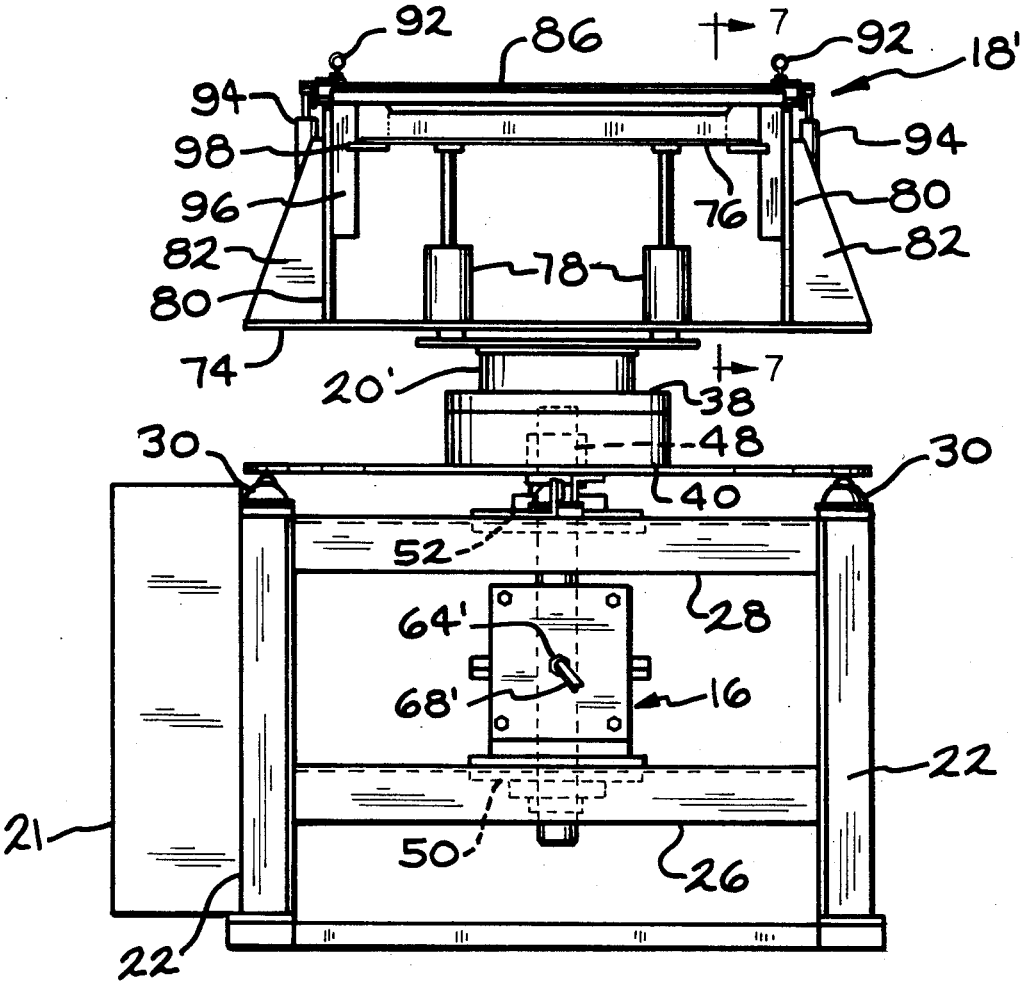
FIG. 3 is an end view of the apparatus shown in FIG. 1.

The rotatable table 14 is shown in FIGS. 1, 2 and 3. The rotatable table 14 includes an upper surface 38 and a lower surface 40. The rotatable table 14 further includes a circular plate 42 attached to its lower surface 40. The plate 42 rests on the ball bearing units 30 which are mounted on the base 12. The rotatable table also includes stop members 44 and 44' which are mounted on the lower surface 40 of the table 14. The stop members 44 and 44' limit the rotational movement of the table 14 when the stop members 44 and 44' engage bumper plates 46 and 46' mounted on the base 12.

Referring to FIG. 2, the rotatable table 14 is pivotally mounted on the base 12 by a shaft 48 which is operatively connected to the rotary actuator 16. The shaft 48 extends through the rotary actuator 16. A first bushing 50 mounted on the first set of support members 26 and a second bushing 52 mounted on the second set of support members 28 receiving the shaft 48.

Figure 4:
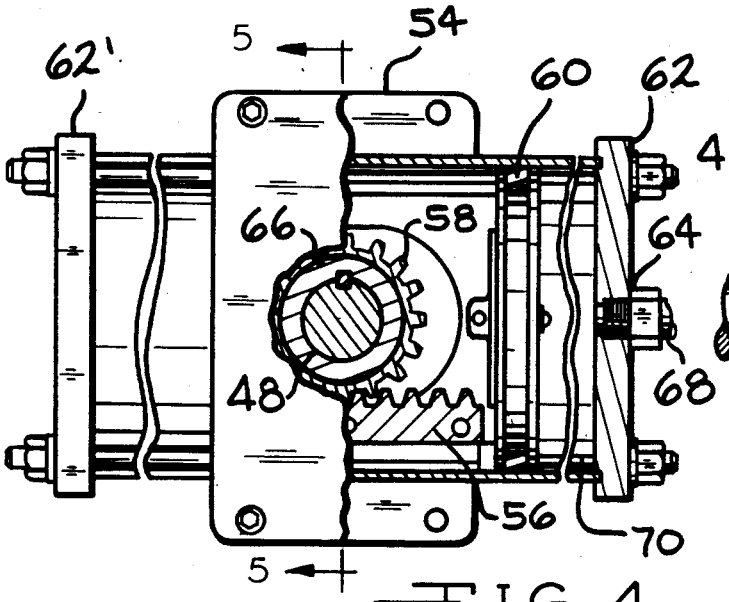
FIG. 4 is a top view of the rotary actuator of the present invention with the housing plate partially cut away.
Figure 5:
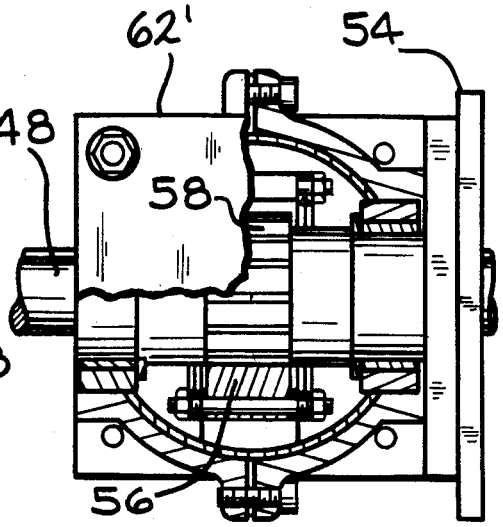
FIG. 5 is a side view of the rotary actuator along line 5—5 of FIG. 4 with the housing plate partially cut away.

The rotary actuator 16 is shown in FIGS. 2, 3, 4 and 5. Referring to FIGS. 4 and 5, the rotary actuator 16 includes a housing 54, a rack 56, a pinion gear 58 engaged with the rack 56 and a cylinder 60 which drives the rack 56. End plates 62 and 62' are provided. The pinion gear 58 is attached to the shaft 48 by a keyway 66. A pneumatic connector 64 is provided on the end plate 62 and is operatively connected to the pneumatic cylinder 60.

Still referring to FIGS. 4 and 5, the rotary actuator 14 becomes operational when compressed air is directed by the pneumatic control unit 21 through a conduit 68 attached to the pneumatic connector 64. The compressed air is discharged to the pneumatic cylinder 60 which drives the rack 56. Lineal movement of rack 56 causes rotational movement of the pinion gear 58 and shaft 48. The rotational movement of shaft 48 results in the rotation of the table 14 which is connected to shaft 48. The table 14 rotates 180 degrees on its axis when the rack 48 is extended.

The rotatable table 14 rotates in the opposite direction when compressed air is directed to the cylinder 60 and the rack 48 is retracted. In other embodiments (not shown), opposed cylinders are connected to opposed racks. Both racks engage and rotate the pinion gear 58. In this embodiment, the opposed cylinders alternate to rotate the pinion gear 58 and the table 72 in opposite directions through the 180 degree path.

Figure 6:
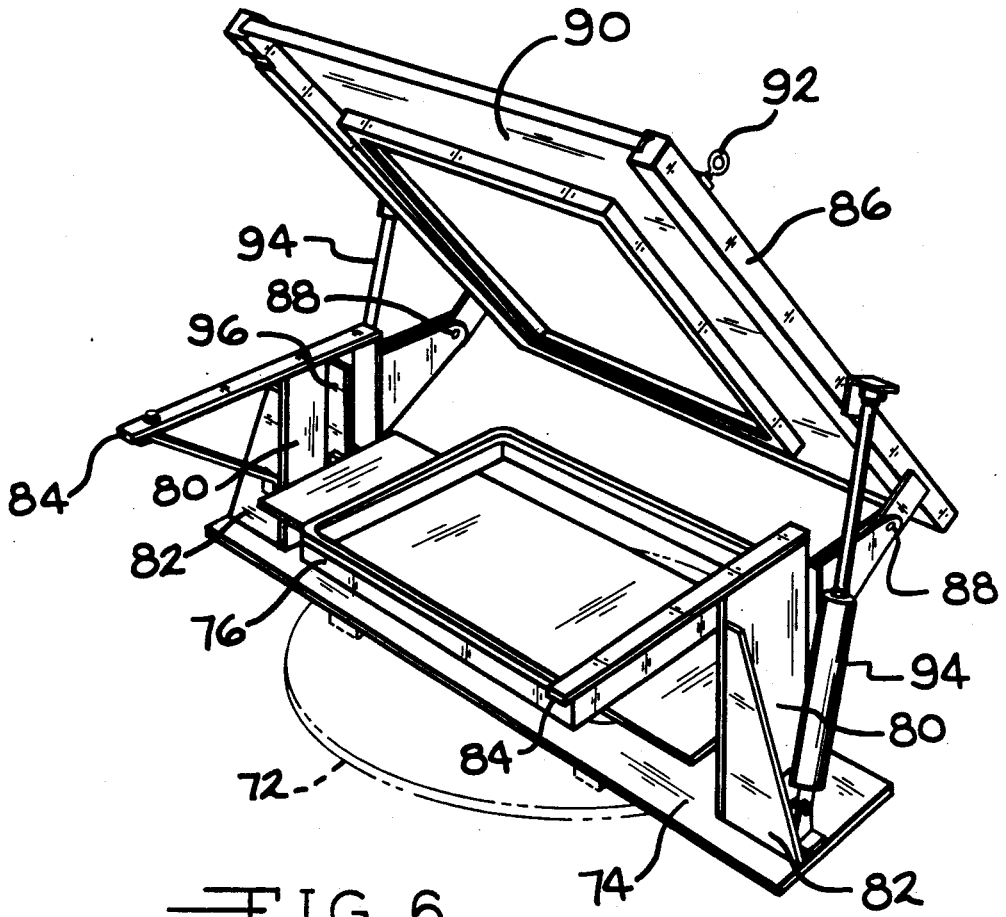
FIG. 6 is a perspective view of a mask holder according to the present invention.

Two mask holders 18 and 18' are positioned on the rotatable table 14 in opposed relationship to one another as shown in FIG. 2. Referring to FIG. 6, each mask holder includes a turntable 72. The turntable 72 is operatively connected to a rotary indexing unit 20. Each mask holder further includes a platform 74 mounted on the turntable 72. A rest pad 76 is connected to the platform 74 by two pneumatic rest pad cylinders 78 as shown in FIG. 1. The rest pad cylinders 78 move the rest pad 76 vertically with respect to the platform 74. The rest pad cylinders 78 operate in response to the pneumatic control unit 21. The rest pad 76 supports and positions an article to be coated during the coating operation.

Still referring to FIG. 6, each mask holder further includes two side supports 80 which extend upwardly perpendicular to the platform 74. Two brace members 82 provide support for the side supports 80. Two mask holder stops 84 extend outwardly from the side supports 80. A mask holder frame 86 is connected to the side supports 80 by hinges 88. A decorative mask 90 is held within the mask holder frame 82 by pins 92.

Two pneumatic mask holder frame cylinders 94 are shown in FIG. 6. Each cylinder 94 is connected to the mask holder frame 86 and the platform 74. The cylinders move the mask holder frame vertically with respect to the rest pad 76. The mask holder frame cylinders 94 operate in response to the pneumatic control unit 21.

Figure 8:
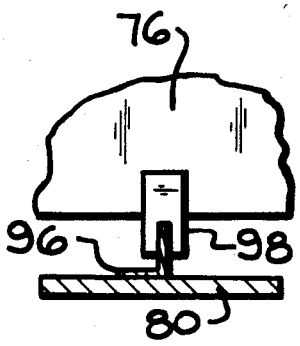
FIG. 8 is a sectional view of a rest pad guide according to the present invention taken along line 8—8 of FIG. 7.

Each mask holder further includes two L-shaped rest pad guides 96 and two mating groove members 98. The guides 96 and groove members 98 can best be seen in FIG. 8. The L-shaped guides 96 are attached to the side supports 80. The groove members 98 are connected to the rest pad 76. The mating of the guides 96 and the groove members 98 keep the rest pad 76 in proper alignment as the pad 76 is moved vertically with respect to the platform 74 by the rest pad cylinders 78.

Figure 7:
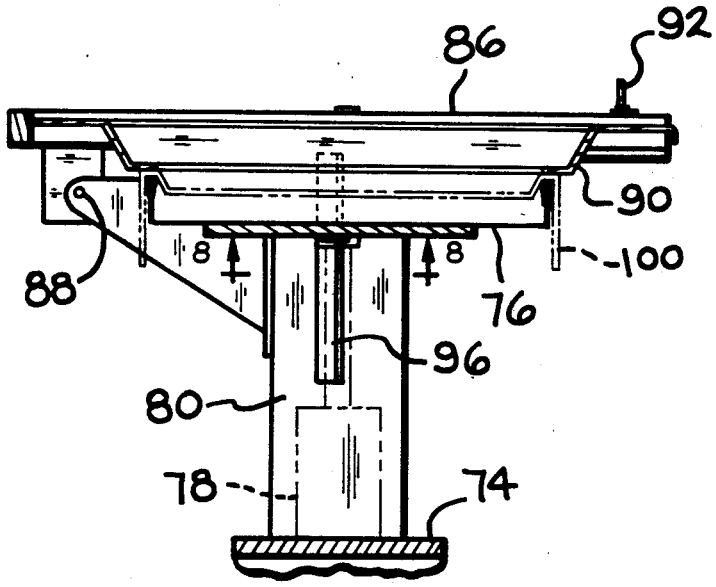
FIG. 7 is a sectional view of a mask holder according to the present invention taken along line 7—7 of FIG. 3.

A mask holder in a closed state is shown in FIG. 7. The mask holder is closed after an article 100 is placed on the rest pad 76. The article 100 can be, for example, a television set bezel or a computer part. The mask holder is closed by the extention of the rest pad cylinders 78 and the retraction of the mask holder frame cylinders 94. When the mask holder is in a closed state, the decorative mask 90 is positioned over the article 100. The mask 90 defines which portions of the article 100 will be coated during the coating operation.

Figure 9:
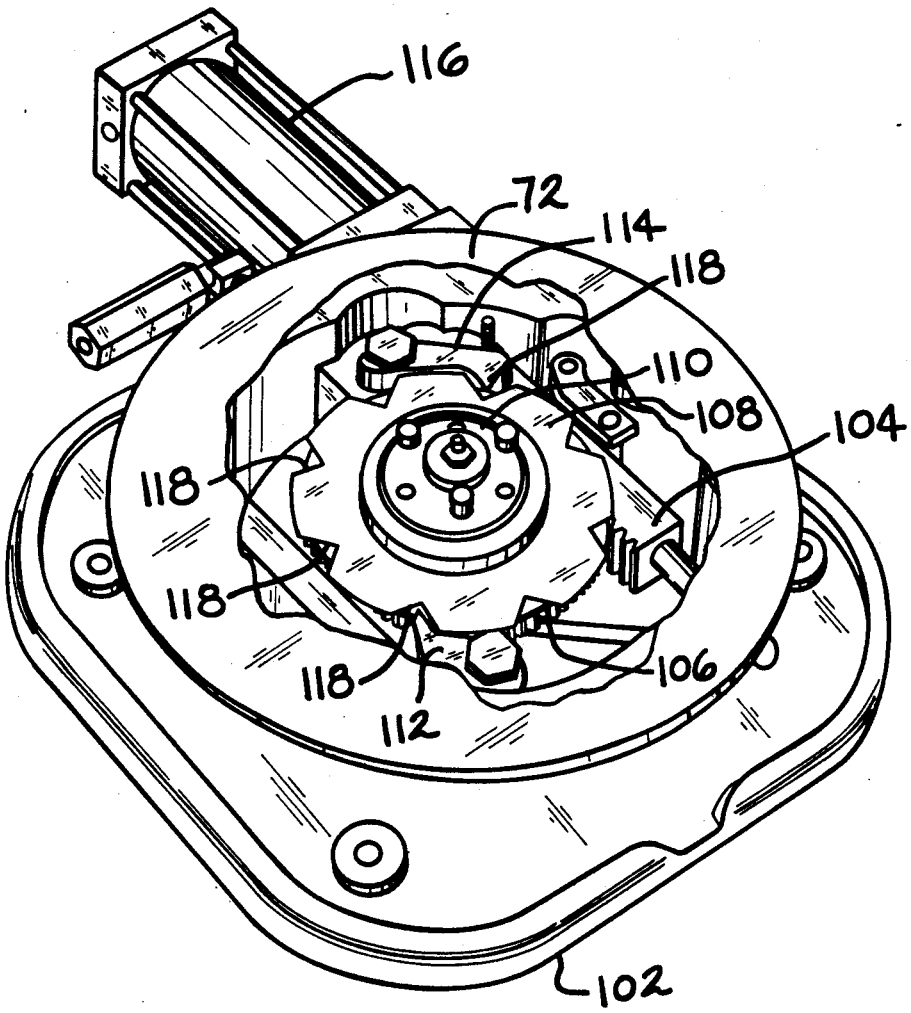
FIG. 9 is a perspective view of a rotary indexing unit according to the present invention with the turn table partially cut away.

Referring to FIG. 2, the mask holders 18 and 18' are mounted on rotary indexing units 20 and 20', respectively. The rotary indexing units 20 and 20' are mounted on the rotatable table 14 in opposed relationship to one another. Referring to FIG. 9, each rotary indexing unit includes a base plate 102, a rack 104, a gear 106, an index plate 108, a center stud 110, a first pawl 112, a second pawl 114, and a pneumatic drive cylinder 116.

Referring to FIG. 9, each rotary indexing unit has the ability to rotate the mask holder to which it is attached 360 degrees at the coating station during a coating operation. This is accomplished when the drive cylinder 116 actuates the rack 104. The drive cylinder 116 operates in response to the pneumatic control unit 21. The rack 104 in turn engages the gear 106 which is connected to the center stud 110 and the index plate 108. The center stud 110 is connected to the turntable 72 of a mask holder. The connection of the mask holder to center stud 110 causes the mask holder to turn in response to the actuation of the rack 104 and gear 106.

Still referring to FIG. 9, the index plate 108 includes a series of index stops on its circumstance. The index stops are indicated generally by reference number 118. The first pawl 112 and the second pawl 114 engage the index stops 118 as the index plate 108 rotates. The pawls when engaged prevent the index plate 108 from moving forward or backward.

Figure 10:
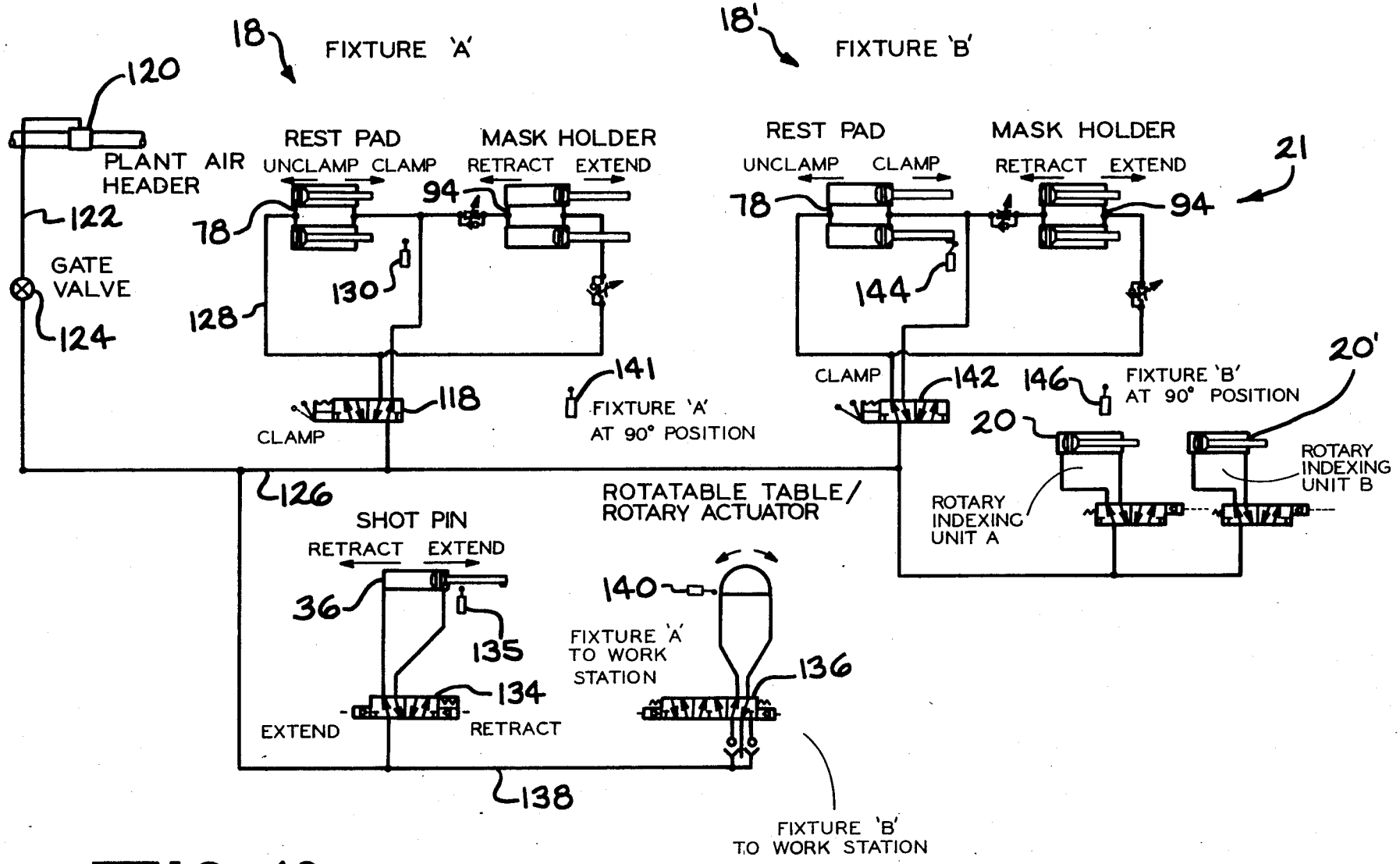
FIG. 10 is a schematic diagram of the pneumatic control means of the present invention.

Referring to FIG. 10, the pneumatic control system or unit 21 is shown diagrammatically. The machine 10 is controlled by the control unit 21 in conjunction with a computer (not shown). Preferably the computer or a microprocessor also controls the operation of a spray painting robot (not shown) which is used to coat the articles being held by the mask holders 18 and 18'.

Referring to FIG. 10, "Fixture A" represents mask holder 18 and "Fixture B" represents mask holder 18'. The initial condition of the machine 10 is tht Fixture A is at the loading/unloading station in an "unclamped" or open state. When a mask holder is in an open state, the rest pad 76 is retracted and the mask holder frame 86 is extended. Fixture B is at the coating station in a "clamped" or closed state. When a mask holder is in a closed state, the rest pad 76 is extended and the mask holder frame 86 is retracted. The shot pin 34 is extended by the shot pin cylinder 36 to hold the rotatable table 14 in place.

The sequence of operations of the machine 10 are as follows:

The operator of the machine 10 places an article 100 on the rest pad 76 of Fixture A. The operator manually activates a first valve 118. The activation of valve 118 causes compressed air to flow from a plant air header 120 through a conduit 122 past a gate valve 124 into lines 126 and 128 to the rest pad cylinders 78 of Fixture A. The rest pad cylinders 78 are extended to clamp. The activation of the first valve 118 also causes the mask holder frame cylinders 94 to retract. This results in the mask holder frame 86, which is attached to the mask holder frame cylinders 94, being lowered until it rests over the article 100.

The clamping of the rest pad cylinders 94 activates a first switch 130. The activation of first switch 130 sends a signal that Fixture A is clamped. In response, the shot pin cylinder 36 is retracted. The shot pin cylinder 36 retracts when a second valve 134 opens. The full retraction of the shot pin cylinder 36 activates a second switch 135.

Still referring to FIG. 10, the activation of the second switch 135 causes a third valve 136 to open. The opening of the third valve 136 allows air flowing through line 138 to actuate the rotary actuator 16 which is operatively connected to the rotatable table 14. The actuation of the rotary actuator 16 causes the rotatable table 14 to rotate 180 degrees on its axis so that Fixture A which has been at the loading/unloading station is moved to the coating station. Likewise, Fixture B which has been at the coating station is moved to the loading/unloading station.

As the rotatable table 14 moves into position a third switch 140 is activated. The activation of the third switch 140 causes the shot pin cylinder 36 to extend. The extention of the shot pin cylinder 36 causes the shot pin 34 to engage the U-shaped retainer 35 mounted on the lower surface 40 of the rotatable table 14 in order to hold the table in place.

The extention of the shot pin cylinder 36 releases the second switch 135. The release of the second switch 135 sends a signal that the painting robot can commence the coating operation on the article being held by Fixture A. The robot then coats a portion of the article.

After the robot has completed the first coating cycle, a signal is sent to the machine 10 to rotate Fixture A. The rotation of Fixture A is accomplished by the actuation of the rotation indexing unit 20 or "rotary indexing unit A" on which Fixture A is mounted. Rotary indexing unit A first rotates Fixture A 90 degrees. The rotation of Fixture A activates a fourth switch 141. The activation of the fourth switch 141 sends a signal that Fixture A has been rotated. The computer then signals the robot, for example, to coat a second portion of the article. This sequence of events is repeated until Fixture A has been rotated a desired number of times and the article is completely coated.

Meanwhile at the loading/unloading station, the operator of the machine 10 manually activates a fourth valve 142 which is operatively connected to mask holder 18' or "Fixture B". The activation of valve 142 causes the rest pad cylinders 78 of Fixture B to unclamp and the mask holder frame cylinders 90 to extend thereby releasing a finished article. The operator removes the finished article and loads a new article to be coated on the rest pad 76 of Fixture B. The operator again activates the fourth valve 142 causing the rest pad 78 and mask holder frame cylinders 94 to clamp the article to be coated.

The clamped rest pad cylinders activate a fifth switch 144. The activation of the fifth switch 144 sends a signal that Fixture B is clamped. This causes the shot pin cylinder 36 to retract. The retraction of shot pin cylinder 36 activates the second switch 135. The activation of switch 135 causes the third valve 136 to open allowing compressed air to actuate the rotary actuator 16. The actuation of the rotary actuator 16 causes the rotatable table 14 to rotate 180 degrees. This results in Fixture B moving from the loading/unloading station to the coating station. Fixture A returns to the loading/unloading station.

Still referring to FIG. 10, as the rotatable table 14 moves into position the third switch 140 is activated. The activation of the third switch 140 causes the shot pin cylinder 36 to extend the shot pin 34 to hold the rotatable table in place. The extension of the shot pin cylinder 36 releases the second switch 135.

The release of the second switch 135 sends a signal that the robot can commence the coating operation on the article being held by Fixture B. The robot then coats a portion of the article.

After the first coating cycle, a signal is sent to the machine 10 to rotate Fixture B. Fixture B is rotated by rotary indexing unit 20' or "rotary indexing unit B". Rotary indexing unit B then rotates Fixture B 90 degrees. The rotation of Fixture B activates a sixth switch 146. The rotary indexing unit B then rotates Fixture B 360 degrees as described above for Fixture A.

The operator at the loading/unloading station activates first valve 118 releasing the finished part from Fixture A. The operator then loads a new part onto Fixture A and the operation of the machine 10 as described above is then repeated.

It should be understood that many changes and modifications may be made to the structure disclosed in the drawings and still fall within the scope of the following claims.

What I claim:

1. An robotic paint masking machine comprising;

a base;

a rotatable table pivotally mounted on said base, said table rotating at least 180 degrees;

a rotary actuator mounted on said base and operatively connected to said rotatable table for rotating said table;

at least two mask holders positioned on said table in opposed relationship to one another, each of said mask holders including a vertically movable frame for holding a decorative mask; and a rotary indexing unit mounted between said table and each of said mask holders for rotating said mask holder during a painting operation.

2. The machine according to claim 1, wherein said base includes a plurality of legs, a first set of support members attached to a perpendicular relationship to said legs, a second set of support members attached in a perpendicular relationship to said legs and a plurality of ball bearing units mounted between one of said plurality of legs and said rotatable table.

3. The machine according to claim 2, including a shot pin assembly mounted on said base, said shot pin assembly comprising a shot pin and a shot pin cylinder operatively attached to said assembly, whereby when said shot pin cylinder is extended, said shot pin engages said rotatable table thereby locking said rotatable table from rotational movement.

4. The machine according to claim 1, wherein said rotatable table includes an upper surface, a lower surface and a plate attached to said lower surface of said table.

5. The machine according to claim 1, including a shaft depending from said rotatable table, a pinion gear mounted on said shaft, said rotary actuator including a housing, a rack mounted within said housing adjacent said pinion gear, said pinion gear being operatively engaged with said rack, cylinder means operatively connected to said rack for reciprocating said rack, whereby the reciprocating rack rotates said pinion gear, said shaft and said table.

6. The machine according to claim 5, including stop means for limiting rotation of said table.

7. The machine according to claim 1, wherein each of said mask holders further includes a turntable, a platform mounted on said turntable, two side supports extending upwardly perpendicular to said platform, a rest pad operatively connected to said platform, cylinder means extending between said rest pad and said platform, said cylinder means moving said rest pad vertically with respect to said platform, said rest pad supporting and positioning an article to be coated during the painting operation, and at least one mask holder frame cylinder means connected to said movable frame and said platform, said mask holder frame cylinder means moving said movable frame vertically with respect to said rest pad.

8. The machine according to claim 7, wherein each of said mask holders further includes opposed L-shaped rest pad guides attached to said supports and two mating groove members attached to said rest pad, whereby said L-shaped guides engage said mating groove members to align said rest pad as said rest pad is moved vertically by said rest pad cylinders.

9. The machine according to claim 1, wherein each of said rotary indexing units includes a base, a rack, a gear operatively engaged with said rack, an index plate mounted on said gear, a connecting means joining said gear and said mask holder and a drive cylinder operatively connected to said rack, whereby when said drive cylinder is actuated, said drive cylinder actuates said rack turning said gear, said gear rotating said mask holder during a painting operation.

* * * * *